United States Patent [19]

Mazurek et al.

[11] Patent Number: 5,005,728

[45] Date of Patent: Apr. 9, 1991

[54] END SHAPE MODIFICATION TO REDUCE END HOOK WRINKLING

[75] Inventors: Stanley L. Mazurek, Rolling Meadows; Robert A. Winkless, Oak Lawn, both of Ill.

[73] Assignee: Continental Can Co., Inc., Norwalk, Conn.

[21] Appl. No.: 392,891

[22] Filed: Aug. 14, 1989

[51] Int. Cl.[5] ..... B65D 8/00

[52] U.S. Cl. ..... 220/619

[58] Field of Search ..... 220/66, 67, 72, 74, 220/79, 610, 615, 619, 620, 623

[56] References Cited

U.S. PATENT DOCUMENTS

| | | | |
|---|---|---|---|
| 2,739,732 | 3/1956 | Bogner | 220/67 X |
| 3,139,211 | 6/1964 | Bogner | 220/67 X |
| 3,700,524 | 10/1972 | Sato | 220/67 X |
| 4,163,504 | 8/1979 | Elser | 220/66 |
| 4,508,569 | 4/1985 | Kumasaka et al. | 220/67 X |
| 4,641,761 | 2/1987 | Smith et al. | 220/66 |
| 4,854,467 | 8/1989 | Budenbender | 220/67 |

*Primary Examiner*—Stephen Marcus
*Assistant Examiner*—Nova Stucker
*Attorney, Agent, or Firm*—Charles E. Brown; Charles A. Brown

[57] ABSTRACT

This relates to a conventional type metal container end having a modified end hook configuration for the purpose of eliminating undesired wrinkles within a conventional type of double seam between a metal container end and a container body. Most particularly, a customary straight section between an end curl and a cut edge of the metal container end is eliminated so that the end curl terminates at the cut edge. Additionally, the end curl is reinforced so as to stiffen the end curl by providing a reinforcement generally in the area of the normal juncture between a seaming panel and the end curl. In a preferred embodiment the reinforcement is arched primarily upwardly.

13 Claims, 1 Drawing Sheet

FIG. 1
Prior Art
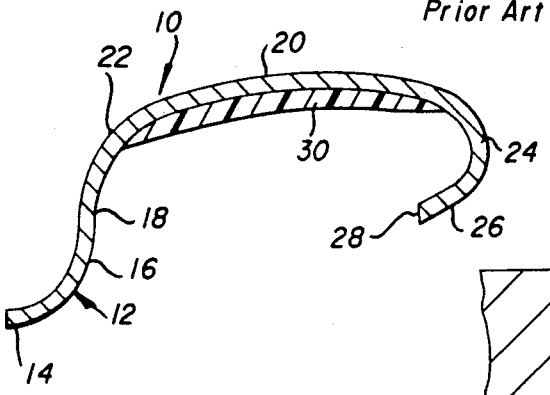
FIG. 2
Prior Art
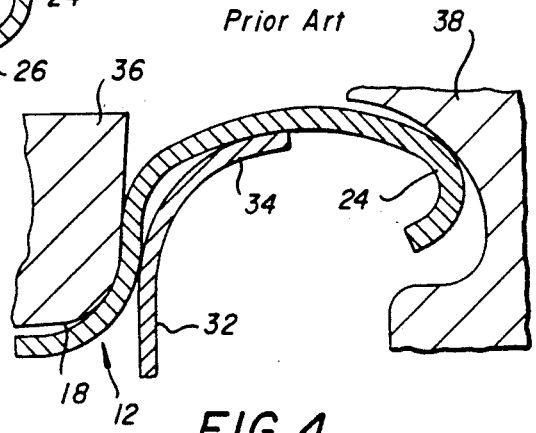
FIG. 3
Prior Art
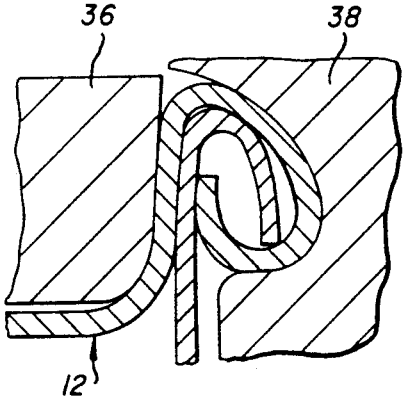
FIG. 4
Prior Art
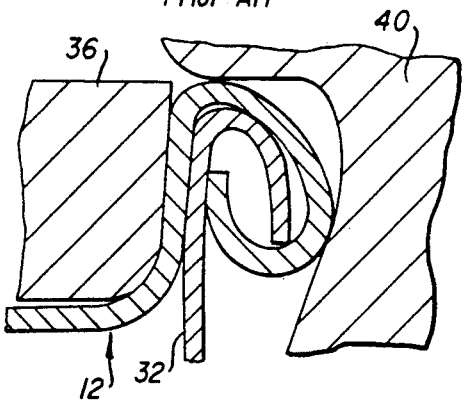
FIG. 5
Prior Art
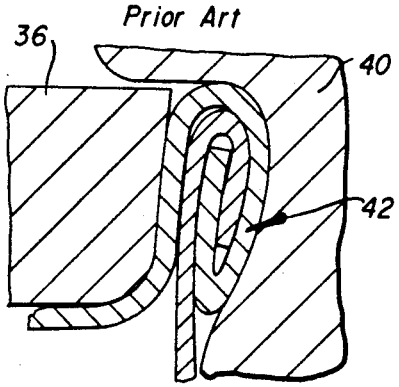
FIG. 6
Prior Art
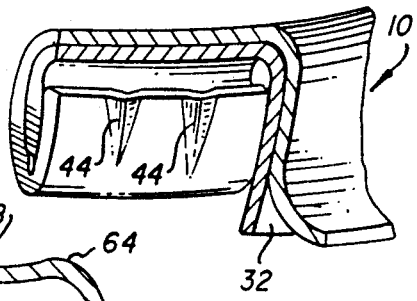
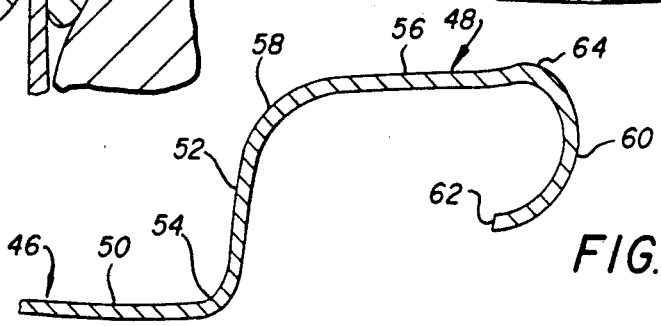
FIG. 7

END SHAPE MODIFICATION TO REDUCE END HOOK WRINKLING

This invention in general relates to a modification of the shape of an end hook portion of a metal end unit to reduce wrinkling during the formation of a double seam between the metal end unit and a container body.

In order to provide a leak-free assembly of a container or a can end with a container body, the container body and end are joined together by a process called double seaming.

To form a double seam, a rotating seaming chuck and spring loaded base plate hold the end and body components together while rotating first and second operation seaming rolls which are cam sequenced in and out to form the double seam.

In the past, metal container ends were of a considerably greater metal thickness than that which is now being utilized. As end metal thicknesses are reduced, abnormal wrinkling becomes more prominent in the end hook next to a cut edge where the diameter of the end is reduced by the first operation seaming roll action. The wrinkles are formed in the seaming operation during the time when the first operation seaming roll makes contact with the end until approximately one-half of the inward roll travel. These wrinkles, in contrast to normal tightness wrinkles, cannot be "ironed" out of the end hook by forming a tight seam by the second operation roll groove action.

If these wrinkles are large enough, the channels or "V"s and pleats formed can pass bacteria which will destroy the product contents of the container and cause vacuum loss through leakage as well as damage to the lacquer film on the container ends and may result in cracks and metal exposure, to name a few potential container problems.

There are several factors that can contribute to this abnormal wrinkling:

1. Incorrect first operation roll setting.
2. Worn or incorrect first operation roll profile.
3. Poor end material formability (from light gauge plate).
4. Improper end curl shape. A straight section next to the end cut edge permits line contact with the first seaming roll rather than surface-to-surface contact. The localized high forces bend the end material to form the undesired wrinkle.

To illustrate the influence of the straight section, the 0.0094" plate was run under identical seamer setup conditions with the following results:

0.030" straight edge section produced severe wrinkles.

0.015" straight edge portions produced slight wrinkling.

Incorrect seaming roll settings or worn rolls are easily corrected on the customary double seamer. The abnormal wrinkles discussed above are present with proper roll settings and roll grooves with reduced end metal thicknesses.

The wrinkling problem has been recognized in the past and different steps have been made to overcome it. For example, in the patent to Stuchbery et al U.S. Pat. No. 3,083,663, the end curl or the straight edge portion adjacent 70 the cut edge is corrugated in advance to eliminate wrinkling.

Smith, U.S. Pat. No. 3,263,636, although it relates to the formation of an indentation in a seaming panel remote from the end curl to provide a recloseable can, does show the end curl terminating at the cut edge. Baker, U.S. Pat. No. 3,367,533 attempts to solve the wrinkling problem by providing the can end with a curl which terminates at the cut edge. However, the curl is reversely folded in forming the double seam.

More recent patents, including Wessely U.S. Pat. No. 4,055,133; Franek et al U.S. Pat. No. 4,626,157 and LeBret et al U.S. Pat. No. 4,697,972 discloses a can end end hook having a curl which terminates at the cut edge. Frankenberg U.S. Pat. No. 3,556,031, in lieu of the customary arched seaming panel discloses a flat seaming panel.

Wobbe U.S. Pat. No. 2,643,627 teaches that the seaming panel, in the final seaming operation, may be outwardly bowed to form a cushion.

In accordance with this invention, not only is the end hook configuration modified so as to eliminate the straight portion next to the cut edge so that the curl terminates at the cut edge, but also to incorporate a reinforcing shape between the seaming panel and the end curl which reinforces the end curl region to better withstand the forces placed on the end curl by the first operation roll. This combination permits lower weight ends to be double seamed without wrinkling.

With the above and other objects in view that will hereinafter appear, the nature of the invention will be more clearly understood by reference to the following detailed description, the appended claims, and the several views illustrated in the accompanying drawings.

FIG. 1 is a sectional view taken through the hook portion of a container end as known in the prior art.

FIG. 2 is a sectional view taken through overlapped peripheral portions of a container body and end portions as first engaged by a first operation seaming roll.

FIG. 3 is a sectional view similar to FIG. 2 but wherein the peripheral portions have been partially interlocked at the end of the seaming operation by the first operation seaming roll.

FIG. 4 is another sectional view similar to FIG. 2 and shows the partially locked together peripheral portions as first engaged by a second operation seaming roll.

FIG. 5 is yet another sectional view similar to FIG. 2 and shows the cross section of the double seam at the completion thereof.

FIG. 6 is a fragmentary sectional view cut along a generally circumferential line of a prior art double seam utilizing the end unit of FIG. 1 and showing the undesired wrinkle.

FIG. 7 is a fragmentary sectional view taken primarily through the end hook portion of a modified end hook configuration in accordance with this invention.

Referring now to the drawings in detail, reference is first made to the prior art showing of FIG. 1 wherein there is illustrated the hook portion of a conventional metal end for a can or container, particularly one which is utilized in the packaging of a food product, the container end being generally identified by the numeral 12.

The end hook portion 10, as illustrated, starts with a chuck panel 14 which terminates at a chuck wall radius 16 which, in turn, terminates at a chuck wall 18. The chuck wall 18 is joined to an arched seaming panel 20 by a seaming panel radius 22. The seaming panel 20 terminates in a curl 24, which, in turn, terminates in a straight portion 26. The straight portion 26 terminates in a cut edge 28.

In order to assure the forming of a sealed double seam, the interior of the seaming panel 20 is normally coated with a thin layer of a suitable sealing compound 30.

The container end 12 is applied to a container body 32 which terminates in a radially outwardly curved flange 34.

In a conventional double seaming operation, the end 12 is seated on the flange 34 in a closing machine and then is urged tightly against a seaming chuck 36 which engages the chuck wall 18 as is shown in FIG. 2. Thereafter, a rotating first operation seaming roll 38 is cammed towards the rotating chuck 36 to initially engage the curl 24, as is shown in FIG. 2.

Thereafter, with the can components and the seaming chuck rotating, the first operation seaming roll 38 is further cammed towards the seaming chuck 36 to a final position, as is shown in FIG. 3.

It is to be understood that in a conventional closing machine, a second operation seaming roll 40 is positioned generally diametrically opposite the first operation seaming roll 38. The seaming roll 40 is also cam advanced towards the seaming chuck 36 and picks up the partially formed double seam between the container end 12 and container body 32 as shown in FIG. 4. As the parts continue to rotate with the seaming chuck 36, the second operation seaming roll is advanced by its associated cam towards the seaming chuck 36 to complete the double seaming operation as is shown in FIG. 5. The resultant double seam is generally identfied by the numeral 42.

At this time it is pointed out that no attempt has been made to illustrate the sealing compound 30 in FIGS. 2 through 5.

Referring now to FIG. 6, it will be seen that when the conventional end hook portion 10 is provided with the straight section 26 and is formed of lighter gauge metal, undue wrinkling will result as at 44. This invention relates to the modification of the end hook configuration so as to eliminate the wrinkles 44 and the formation of a double seam utilizing lighter gauge material generally to form the body 32 and specifically to form the container end 32 as is shown in FIG. 7.

Referring now to FIG. 7, it will be seen that there is illustrated a light weight container end generally identified by the numeral 46, the container end 46 being particularly modified as to the configuration of an end hook 48 thereof. The end hook 48 includes a customary chuck panel 50 to which there is joined a customary chuck wall 52 by a customary chuck wall radius 54. The chuck wall 52 is, in turn, joined to a seaming panel 56 by a customary seaming panel radius 58. The seaming panel 56 is modified as will be described in detail hereinafter.

The end hook portion 48 terminates in an end curl 60 which extends completely to a cut edge 62, the prior straight section being eliminated.

In addition to eliminating the straight section of the prior art end hook configuration, the seaming panel 56 is preferably flat and may slope slightly upwardly and radially outwardly. Further, the seaming panel does not terminate in the end curl, there being interposed between the end curl 60 and seaming panel 56 a reinforcing shape 64. The reinforcing shape 64 is arched primarily upwardly, but may be arched also slightly outwardly. The reinforcing shape 64, reinforces the end curl region to better withstand the forces placed on the end curl by the first operation seaming roll. This permits lighter base weight ends to be double seamed with minimum wrinkling.

At this time it is pointed out that conventional end forming die practices may be employed to achieve the desired reinforcing shape that increases the end material formability.

Adding the reinforcing shape 64 and eliminating the straight section next to the cut edge permits double seaming with a minimum of or no wrinkles of light weight ends.

Although only a preferred embodiment of the invention has been specifically illustrated and described herein, it is to be understood that minor variations may be made in the end hook configuration without departing from the spirit and scope of the invention as defined by the appended claims.

We claim:

1. An end hook configuration for a container end of the type including a chuck wall, a seaming panel radius joining a seaming panel to said chuck wall, said seaming panel terminating in an end curl, and said end hook terminating in a cut edge, said end hook configuration being improved by said end curl terminating at said cut edge, and said end hook having reinforcement means formed of the same material as the end hook for said end curl at an intersection between said seaming panel and said end curl, and said end curl being of a positive continuous curvature which extends to said cut edge.

2. An end hook configuration according to claim 1 wherein said reinforcement means is in the form of an outwardly arched shape.

3. An end hook configuration according to claim 1 wherein said reinforcement means is in the form of an elongated outwardly arched shape.

4. An end hook configuration according to claim 1 wherein said reinforcement means is in the form of an outwardly arched shape, said outwardly arched shape being in part formed by a portion of said end curl and in part by an arched radially outer portion of said seaming panel.

5. An end hook configuration according to claim 4 wherein said seaming panel is otherwise substantially flat.

6. An end hook configuration according to claim 4 wherein said seaming panel is otherwise substantially flat and slopes upwardly and radially outwardly.

7. An end hook configuration for a container end of the type including a chuck wall, a seaming panel radius joining a seaming panel to said chuck wall, said seaming panel terminating in an end curl, and said end hook terminating in a cut edge, said end hook configuration being improved by there being reinforcement means formed of the same material as the end hook for said end curl at an intersection between said seaming panel and said end.

8. An end hook configuration according to claim 7 wherein said reinforcement means is in the form of an outwardly arched shape.

9. An end hook configuration according to claim 7 wherein said reinforcement means is in the form of an elongated outwardly arched shape.

10. An end hook configuation according to claim 7 wherein said reinforcement means is in the form of an outwardly arched shape, said outwardly arched shape being in part formed by a portion of said end curl and in part by an arched radially outer portion of said seaming panel.

11. An end hook configuration according to claim 10 wherein said seaming panel is otherwise substantially flat.

12. An end hook configuration according to claim 10 wherein said seaming panel is otherwise substantially flat and slopes upwardly and radially outwardly.

13. An end hook configuration according to claim 8 wherein said reinforcement means is flattened after said container end is double seamed to a container body.

* * * * *

UNITED STATES PATENT AND TRADEMARK OFFICE

CERTIFICATE OF CORRECTION

PATENT NO. : 5,005,728

DATED : April 9, 1991

INVENTOR(S) : Stanley L. Mazurek & Robert A. Winkless

It is certified that error appears in the above-identified patent and that said Letters Patent is hereby corrected as shown below:

Column 4, line 47, claim 7, delete "said end." and substitute therefor --said end curl, and said end curl being of a positive continuous curvature which extends to said cut edge.--

Signed and Sealed this

Second Day of November, 1993

*Attest:*

*Attesting Officer*

BRUCE LEHMAN

*Commissioner of Patents and Trademarks*